United States Patent [19]

Marzocchi

[11] 4,253,217

[45] Mar. 3, 1981

[54] LACING SYSTEM FOR SKI BOOTS

[75] Inventor: Lorenzo Marzocchi, Bologna, Italy

[73] Assignee: Garmont S.p.A., Volpago del Montello, Italy

[21] Appl. No.: 42,262

[22] Filed: May 24, 1979

[51] Int. Cl.[3] ..... A43C 11/14

[52] U.S. Cl. ..... 24/69 SK; 24/71 SK; 36/50; 36/117

[58] Field of Search ..... 24/69 R, 69 ST, 69 TT, 24/69 CT, 69 CF, 69 T, 69 TM, 69 TS, 69 J, 69 AT, 69 FP, 69 SB, 69 WT, 69 EF, 69 SK, 70 R, 70 SK, 70 T, 70 CT, 70 TT, 70 ST, 70 J, 71 R, 71 T, 71 ST, 71 TT, 71 SB, 71 A, 71 J, 71 TD, 71 CT, 71 SD, 71 SK; 36/50, 117, 118, 119, 120; 81/314, 384

[56] References Cited

U.S. PATENT DOCUMENTS 4,112,557 9/1978 Salomon ..... 24/70 SK

*Primary Examiner*—Roy D. Frazier
*Assistant Examiner*—Alexander Grosz
*Attorney, Agent, or Firm*—Guido Modiano; Albert Josif

[57] ABSTRACT

Lacing system for ski boots adapted to pull tight the boot flaps around a skier's foot by means of fastener devices comprising each a first over-center hooked latching lever arranged on one of two flaps of the boot uppers, and a connecting link secured to the other of the two flaps of the boot uppers and insertable into adjustment notches provided on the first lever. A second over-center lever has hinge means for hingedly securing it on the above one flap and having pivot means for pivotally supporting thereon the first lever. The pivot means are offset with respect to the hinge means thereby to act through the second lever on the first lever via the pivot means.

5 Claims, 6 Drawing Figures

LACING SYSTEM FOR SKI BOOTS

BACKGROUND OF THE INVENTION

This invention relates to a lacing system for ski boots adapted to pull tight around a skier's foot.

As is known, ski boots adapted to be pulled to a tight fit around the skier's feet conventionally employ over-center latching levers which are journalled to one of two flaps in the boot uppers, which levers when turned by the skier or boot wearer towards a closed position and connected to the other flap by means of links, usually made of wire, place both flaps under tension, and are prevented from spontaneously tilting towards the open position after having overcome the dead-center position of its rotation. The tension exerted by the boot on the foot is adjusted by the skier by engaging said links onto one or the other of adjustment notches generally formed along said levers.

Through that known system, to achieve an adequate tension, a considerable manual effort must be exerted on each lever, the effectiveness of which effort is the more limited the farther from the lever fulcrum the notch wherein said link is engaged is located, while it should be considered that the skier is required to produce such effort in a particularly uncomfortable and tiresome position, i.e. leaning forward to reach down to his/her feet. Thus, said lever tends to strongly oppose an attempt to turn it and achieve the high tensions required for a sporting application, but also to achieve only average tension levels, which is specially inconvenient when such a muscular effort is expected of a woman or a teenager.

Moreover, after all the hand effort has been spent to overcome the dead-center of the rotation of the lever, the strong and unimpeded snapping of the lever upon overcoming the dead-center may be hazardous for one's fingers if the latter happen to get caught between the lever and the boot uppers. In addition, to reopen the lever after it has been forced to close beyond said dead-center, the skier or wearer of the boots has to overcome a considerable amount of resistance with his/her hand.

SUMMARY OF THE INVENTION

In view of the foregoing, this invention sets out to provide a lacing system for ski boots which can pull the boot tight around the foot with greater tension and less manual effort, which effort is in practice unaffected by the distance of the selected notch from the lever fulcrum, and wherein the snapping of the lever after having overcome the dead-center of its travel is considerably reduced, as reduced is also the resistance opposed by the thus forcibly closed lever to an attempt at reopening it.

According to one aspect of the present invention, there is provided a lacing system for ski boots adapted to pull tight around a skier's foot by means of fastener devices comprising each a first over-center hooked latching lever arranged on one of two flaps of the boot uppers, and a connecting link secured to the other of said two flaps of the boot uppers and insertable into adjustment notches provided on said first lever, characterized in that it further comprises a second over-center lever having hinge means for hingedly securing it on said one flap and having pivot means for pivotally supporting thereon said first lever, said pivot means being offset with respect to said hinge means thereby to act through said second lever on said first lever via said pivot means.

BRIEF DESCRIPTION OF THE DRAWINGS

By way of example only, the instant lacing system will be described hereinafter with reference to the accompanying drawings, where.

DESCRIPTION OF THE PREFERRED EMBODIMENTS

Figure 4:
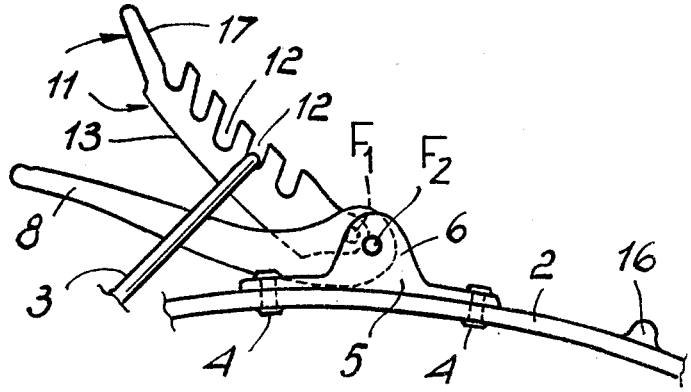
FIG. 4 shows said two levers of the fastener, a first lever being represented at the start of its closure rotation, and a second lever still tilted in the open or released position.

With reference to the drawing figures, the ski boot comprises a first uppers flap 1 located more inside of the boot and a second flap 2 located more outside. The two flaps can be pulled tight by means of fastener devices including latches, levers and tie links. In particular, each loop-like link 3 is pivotally attached to the flap 1 in a manner per se known and not further illustrated. The links are made of metal wire. Each base plate 5 is attached to the flap 2 by means of rivets 4, each plate 5 being provided with a pair of lugs 6. Hingedly connected thereto through a pair of central holes 7 formed therein is a second or booster over-center lever 8 of U-like cross-section. The hinged connection is obtained by means of a pivot pin 7' passing in addition to holes 7 also through a pair of holes 7'' formed through two ribs or sidewalls 9 of said second lever. It will be appreciated that in assembled condition the holes 7, the pivot pin 7' and the holes 7'' define a fulcrum $F_2$ of the second lever 8. In a pair of holes 10 formed nearby through those same ribs there is pivotally connected thereto a first over-center hooked latching lever 11 by means of a pivot pin 10' engaged in a hole 10'' formed in said first lever. The lever 11 has a series of hook or rack formations or notches 12 and a back 13 on the opposite side. It will be appreciated that in assembled condition the holes 10, the pivot pin 10' and the hole 10'' are all coaxial to each other and define a fulcrum $F_1$ (FIGS. 2 and 4) of the first lever 11.

The loop of the links 3 has a width greater than the width of a booster lever 8 described below so that this latter may pass therethrough. Moreover the distance between the side walls or ribs 9 of the booster lever 8 is greater than the width of the lever 11.

Figure 5:
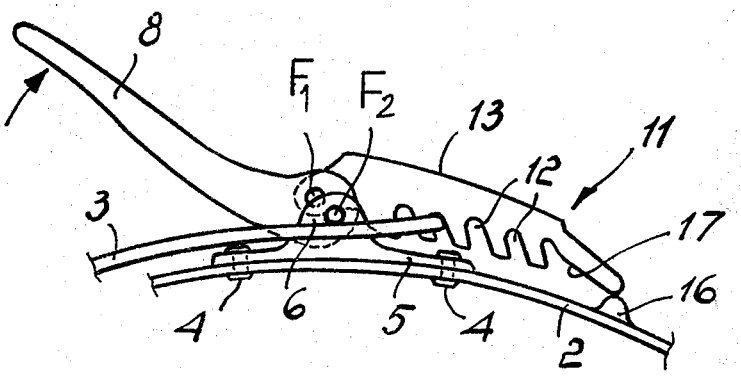
FIG. 5 shows the first lever at the end of its closure rotation and the second one still tilted open.
Figure 6:
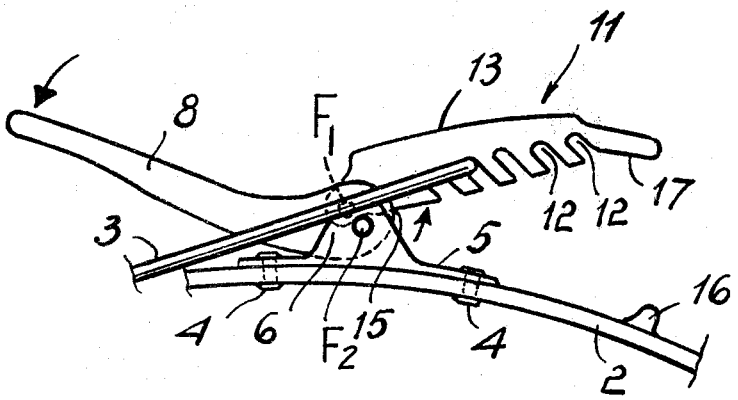
FIG. 6 shows the second lever at the end of its opening rotation, after the first lever has been forced to open by overcoming in the opening direction the deadcenter of its rotation.

The lever 8 has a window 14 provided in the walls thereof coinciding with the web of the U-section shape thereof, the width of such window being greater than the width of the lever 11. The lever 8 has further an abutment portion 15, which extends across thereof, against which the lower edge of the lever 11 in the proximity of the hole 10'' abuts when the two levers are at about 180° angular position with respect to each other as shown in FIGS. 5 and 6.

The term "dead-center position" as used throughout this specification should be intended to indicate that angular position of a lever in which the line of action of the resultant of the forces acting on the lever passes through the fulcrum of the lever, so that no hinge moment action is exerted on the lever in this position. In all angular positions before and beyond the dead-center positions the line of action of the resultant of the forces acting on the lever is offset from the lever fulcrum to that a hinge moment action is exerted on the lever in one or the other direction, depending on whether the offset position of the line of action is on the one or the other side with respect to the fulcrum. The intensity of this hinge moment depends on the distance of the line of action of the resultant of the forces acting on the lever from the fulcrum thereof and on the intensity of the force itself.

The above lacing system operates as follows.

Figure 1:
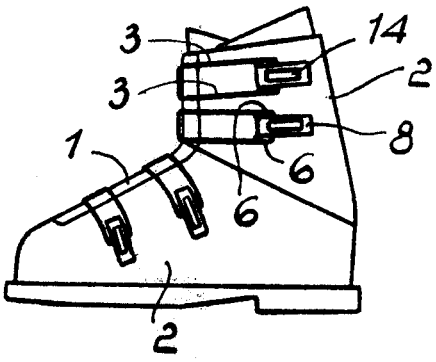
FIG. 1 is a view of the whole boot with the fasteners of the lacing system in the closed or secured position.
Figure 2:
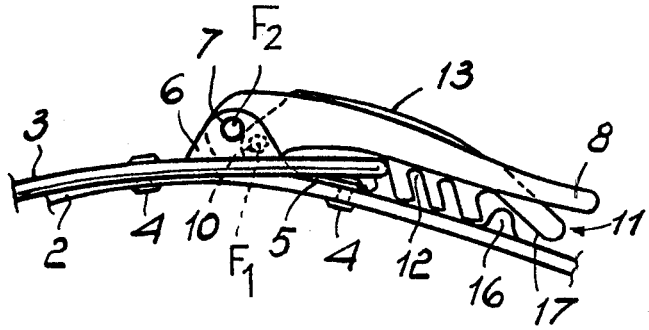
FIG. 2 shows, again in the closed or secured position, one of said fasteners, approximately full size.
Figure 3:
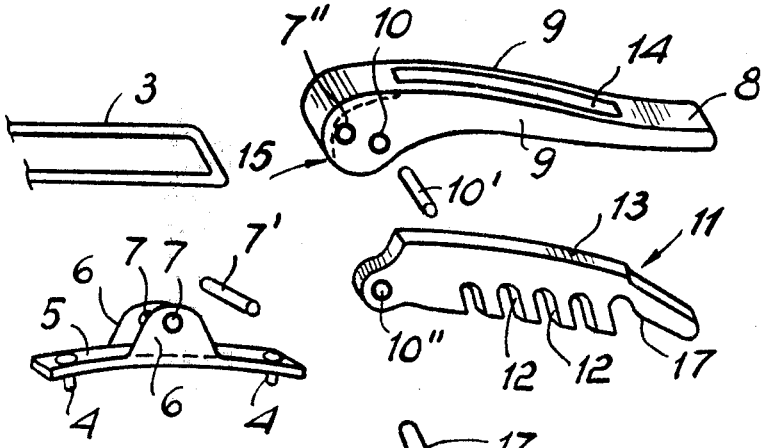
FIG. 3 shows an exploded view of said fastener showing two levers and related ancillary parts.

The user, while holding the lever 11 and lever 8 tilted to an opened position, engages the link 3 in one of the notches 12 for adjusting the tension amount, thus connecting the flap 1 with the flap 2. Thereafter the user moves the lever 11 towards its closed position until the dead-center position of its rotation is exceeded, while the lever 8 is still tilted open (FIGS. 4 and 5), and finally moves the lever 8 towards its closed position until the dead-center position of its rotation is exceeded (FIG. 2). Said lever 8, having a higher mechanical advantage or lever arm ratio or transmission reduction ratio than the lever 11, affords an additional tighter clamping action on the foot with a very limited manual effort. In fact, it will be appreciated that through rotation of lever 8 in the closing direction the fulcrum $F_1$ and the lever 11 itself are additionally shifted in the tensioning direction (compare FIG. 5 with FIG. 2).

In will be further noted from the comparison of these two figures that in the opening position (FIG. 5) of the lever 8 the fulcrum $F_1$ is nearer to the flap 1 (at the left of the Figures) than the fulcrum $F_2$ and in the closing position of the lever 8 (FIG. 2) fulcrum $F_1$ is farther from flap 1 (at the left of the Figure) than fulcrum $F_2$ so that an additional tensioning is thereby obtained.

It will be further understood that the angular position of lever 8 determines also the offset position of the fulcrum $F_1$ of the lever 11 in respect of the tie link 3, i.e. in respect of the line of action of the tying force and determines thereby also the relative position of the forces acting between the levers 8 and 11 regulating thereby also the snapping action.

Upon completion of the closure movement of the lever 8, the lever 11 inserts itself with its back 13 into the window 14 formed in said lever 8, thus producing a shearing effect on any snow or ice build-up which may hinder said closure. If the selected notch of lever 11 creates only a limited tension, as in ordinary boots, when the link 3 is engaged therein it will be sufficient that only the lever 8 is closed which, through its free end remote from the fulcrum $F_2$, will urge the lever 11 to also rotate into the closed position. To reopen or release the boot, the user is only required to make one move by acting on just the lever 8, which by turning counterclockwise in FIG. 6 towards its opened position, during the final portion of its travel is caused to engage with its abutment 15 onto the lower edge of lever 11 still in its closed position, thus urging it to rotate counterclockwise towards the open position at least enough to move beyond the dead-center of its rotation (FIG. 6), thereafter the link 3, which has been moved above the fulcrum $F_1$ i.e. beyond the dead-center position and is still under tension, automatically causes said lever 11 to turn into the fully open position. Should the user only act on the lever 11 instead of the lever 8 in releasing the boot, said lever 11 would engage with its free end against the lever 8 to force it to open also, thus behaving like an ordinary boot latch lever, with attendant higher manual effort requirements for overcoming the dead-center. The projection 16, whereon the lever 11 rests upon completion of its closure rotational movement (FIG. 5), serves for keeping the end of said lever raised and prevent said lever from taking an excessively inclined attitude as, by additional rotation of the lever 8, the fulcrum $F_1$ of the lever 11 is raised by following an arc of a circle. That inclination of the lever 11 may be in fact undesirable because it could urge the link 3 to slide out of its notch. As the fulcrum $F_1$ moves down after completing said arc of a circle, the free end of the lever 11 slides with its inclined surface 17 onto the projection 16 (FIG. 2).

It will be understood from the foregoing that on the lever 8 all lacing force actions are exerted thereon through the pin in the fulcrum paint $F_1$ of the lever 11 so that the dead-center position of lever 8 is determined by the relative position of the fulcrum $F_1$ with respect to the fulcrum $F_2$. It will be further understood that the position of the fulcrum $F_1$ of the lever 11 is determined by the angular position of the lever 8 on the circular arc having its center coinciding with the fulcrum $F_2$, the dead-center position of lever 11 is determined by the angular position of lever 8 when the distances of the fulcrums $F_2$ and $F_1$ are properly selected. Thereby an automatic opening of lever 11 may take place by simply shifting the position of its fulcrum $F_1$ beyond the dead center position thereof in the opening direction, through simple rotation of lever 8.

In practicing the invention, the dimensions, shapes, etc. of the invention may vary as desired without departing from the scope of the instant inventive concept. For example, the pin 7' may only comprise its two terminating portions inserted through the hole pair 7 and 7'', thus eliminating the central idle portion thereof and leaving added space for the body of the lever 8.

I claim:

1. A lacing system for ski boots adapted to pull tight around a skier's foot the two flaps of the boot, comprising a connecting link hingedly secured on one of the flaps of the boot and a pair of levers secured on another of said flaps each of said levers being movable from an opening position into a closing position and viceversa, a first of said levers having a rack formation allowing engagement with said connecting link, a second of said levers having first hinge means defining a first fulcrum point thereon for said first lever, said second lever having second hing means for hingedly securing it on said another flap, said second hinge means defining a second fulcrum point at a distance from said first fulcrum point, thereby to allow said first fulcrum point to move along an arc of a circle the centre of which coincides with said second fulcrum point, when said second lever is rotated about said second fulcrum, said first fulcrum point being located nearer to said one flap than said second fulcrum point when said second lever is in its opening position and said first fulcrum point being located farther from said one flap than said second fulcrum point when said second lever is in its closing position thereby to additionally tighten the closure when said first lever is in its closing position and its rack formation in engagement with said connecting link.

2. A system according to claim 1, characterized in that said two levers are lying in planes parallel to each other and are substantially coextensive.

3. A system according to claim 1, wherein said second lever has an U-section shape in which part of said first lever is arranged and a web portion bridging the wings of the U-section shape, said web portion having a window through which a portion of said first lever may pass to expell matter accumulated therein.

4. A system according to claim 1, wherein said first and second levers have abutment portions defining the limits of relative angular movement thereof, beyond which the levers are in rigid rotatory relation with respect to each other.

5. A system according to claim 1, wherein cam surfaces are provided, cooperating with at least one of said levers near an end position thereof.

* * * * *